United States Patent [19]

Gozzi

[11] 4,334,833

[45] Jun. 15, 1982

[54] FOUR-STAGE GAS COMPRESSOR

[76] Inventor: Antonio Gozzi, Via Giordano, 14, Montale Castelnuovo Rangone, Modena, Italy

[21] Appl. No.: 202,356

[22] Filed: Oct. 28, 1980

[51] Int. Cl.[3] ..... F04B 25/04; F04B 23/10; F04B 19/02

[52] U.S. Cl. ..... 417/258; 417/266; 417/268; 417/243; 417/469; 417/404

[58] Field of Search ..... 417/243, 254, 258, 264, 417/266, 268, 404, 267, 269, 469

[56] References Cited

U.S. PATENT DOCUMENTS

| | | | |
|---|---|---|---|
| 2,007,305 | 7/1935 | Pescara | 417/268 |
| 2,387,603 | 10/1945 | Neugebauer | 417/258 |
| 3,713,755 | 1/1973 | Scheffer | 417/264 |
| 4,173,433 | 11/1979 | Anderson | 417/254 |

*Primary Examiner*—Richard E. Gluck
*Assistant Examiner*—Donald A. Kearney
*Attorney, Agent, or Firm*—Lowe, King, Price & Becker

[57] ABSTRACT

A four-stage gas compressor including: a double-acting piston operable by pressurized oil and provided with first and second hollow opposed piston rods the first of which is connected to a first-stage piston and the second of which is connected to a second-stage piston; said first and second-stage pistons being arranged to slide in first and second jackets respectively and being a sliding fit upon first and second cylindrical bodies respectively; said first and second cylindrical bodies respectively being fixed to first and second opposed heads; a first axial suction and delivery duct leading to an end face of said first cylindrical body, a third stage chamber being defined between said end face and one face of the double-acting piston; and a second axial suction and delivery duct leading to an end face of said second cylindrical body, a fourth stage chamber being defined between said end face of said second cylindrical body and the other face of the double-acting piston.

2 Claims, 1 Drawing Figure

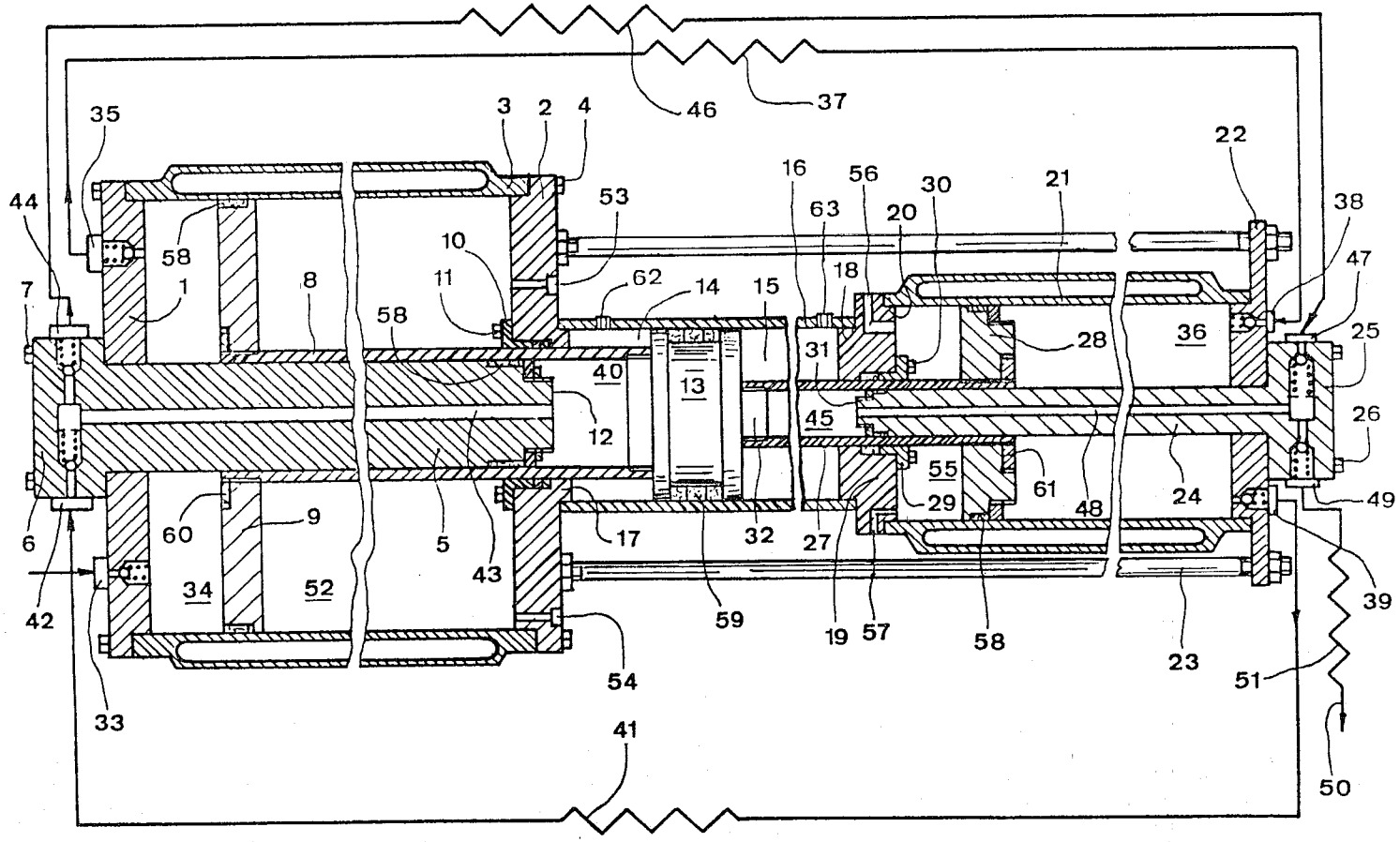
38
47
25
26
49
39
50
51
22
36
24
23
21
28
48
61
58
30
55
29
20
56
18
63
31
45
27
19
57
37
16
15
32
59
46
14
13
62
53
40
12
17
54
41
4
2
3
10
11
43
5
58
8
9
52
58
1
60
34
35
33
44
7
6
42

FOUR-STAGE GAS COMPRESSOR

This invention concerns a four-stage gas compressor, i.e. a machine which compresses gaseous substances such as air, nitrogen or methane and raises them from atmospheric pressure (or from any other pressure whether higher or lower) to a much higher pressure through said machine's four compression stages.

The prior art includes four-stage compressors operated by electric motors or internal combustion engines through crank mechanisms with heavy and cumbersome flywheels to prevent angular speed oscillations. Said prior art also includes one and two stage linear compressors hydraulically operated from the inside of the compressor itself: the two-stage compressors consist of two one-stage linear compressors interconnected with each other.

An object of the present invention is the provision of a relatively compact, single assembly machine which is both four-stage and hydraulically operated.

The present invention provides a four-stage compressor including: a double-acting piston operable by pressurised oil and provided with first and second hollow opposed piston rods the first of which is connected to a first-stage piston and the second of which is connected to a second-stage piston; said first- and second-stage pistons being arranged to slide in first and second jackets respectively and being a sliding fit upon first and second cylindrical bodies respectively; said first and second cylindrical bodies respectively being fixed to first and second opposed heads; a first axial suction and delivery duct leading to an end face of said first cylindrical body, a third stage chamber being defined between said end face and one face of the double-acting piston; and a second axial suction and delivery duct leading to an end face of said second cylindrical body, a fourth stage chamber being defined between said end face of said second cylindrical body and the other face of the double-acting piston.

The invention described herein employs a single mobile element, axially equipped with a double-action hydraulic engine piston, and, in addition, with two pistons for the first and second gas-compression stages, with the gas-compression chambers for the third and fourth stages situated inside the rods of these two pistons, and with the compression itself occurring by means of these same rods. The machine itself has an aligned, coaxial overall design.

The advantages of such a machine are: simplicity and compactness and reduced overall radial and longitudinal dimensions, despite the existence of four stages in a single unit.

By way of example only, a preferred embodiment of the present invention is described in detail with reference to the accompanying drawing, which shows a schematic longitudinal sectional view through a compressor in accordance with the present invention.

Referring to the drawing, a head disc 1 is connected to an intermediate head disc 2 by means of a jacket 3 equipped with a liquid or air cooling system and centred and fixed to the head disc 1 by screws 4. A cylindrical body 5 acts as a fixed third stage piston, and is equipped with a head 6 connecting it to the outside of the head disc 1 by means of screws 7. A cylindrical tubular element 8 coupled with a sliding fit to the body 5 forms the rod of a piston 9, which is fixed to the tubular element 8, to compress the gas in the first stage. A bush 10 is fixed to the intermediate disc 2 by screws 11 and it is internally coupled to the external surface of the tubular element 8 and acts as an oil seal. An end face 12 of the cylindrical body 5 compresses the gas in its third stage.

A double-action piston 13 is internally screwed to the end of the tubular element 8 on the side opposite to the piston 9; this piston 13 creates the alternating motion deriving from the action of the oil contained in the chambers 14 and 15, said oil being pressurised by a hydraulic power unit. A jacket 16 surrounds the hydraulic element in which the piston 13 slides and, on one side, it is centred in an annular projection 17 of the disc 2; on the other side, it it centred in an annular projection 18 of an intermediate head 19. A cooling jacket 21, equipped with liquid or air cooling system, is centred in the annular projection of the head 19, opposite to the projection 18, and in a head disc 22, and houses the second compression stage.

The assembly consisting of the jacket 16, the head 19, the jacket 21 and the head 22 is all axially joined to the disc 2 by tie rods 23. A cylindrical tubular element 24, analogous and opposite to the cylindrical body 5, acts as the fixed piston of the fourth stage and has a head 25 for connection to the disc 22 by means of screws 26. A cylindrical tubular element 27 is coupled with a sliding fit to the body 24 and constitutes the rod of a piston 28 of the second compression stage. A bush 29, analogous to the bush 10, is fixed to the disc 19 by means of screws 30 and is internally coupled to the exterior surface of the tubular element 27, to act also as an oil seal. An interior end face 31 of the cylindrical body 24, analogous and opposite to the face 12, compresses the gas in the fourth stage. A reduced diameter threaded end 32 of the piston 13, opposite to the end to which the cylindrical element 8 is screwed, is screwed to the end of the cylindrical tubular element 27, opposite to the end screwed to the piston 28.

A first-stage suction valve 33 connects the tank of gas to be compressed (not shown) to a chamber 34. A first-stage delivery valve 35 connects the chamber 34 to a second-stage chamber 36, via a cooling coil 37, through a suction valve 38. A second-stage delivery valve 39 connects the chamber 36 to a third-stage chamber 40, via a cooling coil 41, through a suction valve 42 and an axial suction delivery duct 43, located in the body 5. A third stage delivery valve 44 connects the chamber 40 to a fourth-stage chamber 45, via cooling coil 46, through a fourth-stage suction valve 47 and an axial suction and delivery duct 48, located in the cylindrical body 24. A delivery valve 49 connects the chamber 45, via a cooling coil 51, to a user 50 which can be a tank.

The chamber 52, opposite to the first-stage chamber 34, has an outlet port 53 in the disc 2, which vents into the atmosphere any leakage of gas, and an outlet port 54 to discharge any leakage of oil from the bush 10. A chamber 55 is opposite to the second-stage chamber 36 and has an outlet port 56 in the head 19, to vent into the atmosphere any leakage of gas, and a port 57 to discharge any leakage of oil from the bush 29. Gas seals 58 are secured to the piston 28 and oil seals 59 are inserted into the piston 13. The piston 9 is provided with a locking nut 60 to be used if the piston has to be screwed to the tubular element 8. A locking nut 61, analogous to the locking nut 60, fixes the piston 28 to the tubular element 27. The numbers 62 and 63 indicate the oil inlet and drain ports of the chambers 14 and 15 respectively.

The compressor operates as follows: once the oil is delivered under pressure to the chamber 14, the piston 13 moves, lowering the volume of the chamber 15, pulling the first-stage piston 9 and pushing the second-stage piston 28. The movement of the piston 9 increases the volume of the chamber 34 and causes gas to be compressed to be sucked into it through the valve 33. The movement of the piston 28 reduces the volume of the chamber 36 and causes the compression necessary to feed the third-stage chamber 40, through the valves 39 and 42. At the same time, the volume of the fourth-stage chamber 45 is reduced, causing the gas to be compressed to pass through the valve 49 and into the user.

If, on the contrary, the oil is delivered under pressure to the chamber 15, the volume of the chamber 14 is reduced, pushing the first-stage piston 9 and pulling the second stage piston 28. The movement of the piston 9 reduces the volume of the chamber 34, compressing the gas therein which then is fed into the second-stage chamber 36 through the valves 35 and 38. Likewise, the volume of the third-stage chamber 40 is reduced, compressing the gas therein which then is fed into the fourth-stage chamber 45 through the valves 44 and 47. This sequence is repeated in the following cycles.

It will be appreciated that the compression ratios of the above compressor stages may be varied if necessary: for example, each stage may have a compression ratio of 1:4, resulting in an overall compression ratio of $4^4=256$.

What I claim is:

1. A four-stage compressor including: a double-acting piston operable by pressurized oil and provided with first and second hollow opposed piston rods the first of which is connected to a first-stage piston and the second of which is connected to a second-stage piston; said first- and second-stage pistons being arranged to slide in first and second jackets respectively and being a sliding fit upon first and second cylindrical bodies respectively; said first and second cylindrical bodies respectively being fixed to first and second opposed heads; a first axial suction and delivery duct leading to an end face of said first cylindrical body, a third stage chamber being defined between said end face and one face of the double-acting piston; and a second axial suction and delivery duct leading to an end face of said second cylindrical body, a fourth stage chamber being defined between said end face of said second cylindrical body and the other face of the double-acting piston.

2. A compressor as claimed in claim 1 wherein said first and second hollow opposed piston rods comprise jackets around the first and second cylindrical bodies respectively to provide fixed pistons for the third and fourth compression stages respectively.

* * * * *